US011303072B2

(12) United States Patent
Chen

(10) Patent No.: US 11,303,072 B2
(45) Date of Patent: Apr. 12, 2022

(54) ELECTRICAL CONNECTOR AND ELECTRICAL CONNECTOR ASSEMBLY

(71) Applicant: LOTES CO., LTD, Keelung (TW)

(72) Inventor: Chih Kun Chen, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 17/032,355

(22) Filed: Sep. 25, 2020

(65) Prior Publication Data

US 2021/0328388 A1 Oct. 21, 2021

(30) Foreign Application Priority Data

Apr. 16, 2020 (CN) ..... 202020570911.9
Aug. 21, 2020 (CN) ..... 202021770668.1

(51) Int. Cl.
*H01R 31/06* (2006.01)
*H01R 13/6585* (2011.01)
*H01R 13/24* (2006.01)

(52) U.S. Cl.
CPC ..... *H01R 13/6585* (2013.01); *H01R 13/2478* (2013.01); *H01R 13/2485* (2013.01)

(58) Field of Classification Search
CPC ..... H01R 13/6471; H01R 12/724; H01R 13/6587; H01R 13/6585; H01R 12/716; H01R 13/514; H01R 24/60; H01R 2107/00; H01R 12/737; H01R 13/6477; H01R 13/6581; H01R 13/658; H01R 12/721
See application file for complete search history.

(56) References Cited

U.S. PATENT DOCUMENTS

| | | | | |
|---|---|---|---|---|
| 10,297,966 | B1 * | 5/2019 | Hamner | H01R 13/518 |
| 10,530,100 | B1 * | 1/2020 | Henry | H01R 13/6587 |
| 11,145,657 | B1 * | 10/2021 | Or-Bach | H01L 27/10829 |
| 2019/0097356 | A1 * | 3/2019 | Horning | H01R 13/6473 |
| 2019/0103691 | A1 * | 4/2019 | Sypolt | H01R 13/631 |
| 2020/0083625 | A1 * | 3/2020 | Minich | H01R 12/737 |
| 2020/0176934 | A1 * | 6/2020 | Trout | H01R 13/6587 |
| 2021/0328383 | A1 * | 10/2021 | Kimura | H01R 12/75 |

FOREIGN PATENT DOCUMENTS

| | | | |
|---|---|---|---|
| CN | 104466581 | B | 4/2017 |
| CN | 109494499 | A | 3/2019 |
| CN | 209183804 | U | 7/2019 |
| CN | 105470732 | B | 10/2019 |
| CN | 110707493 | A | 1/2020 |

* cited by examiner

*Primary Examiner* — Truc T Nguyen
(74) *Attorney, Agent, or Firm* — Locke Lord LLP; Tim Tingkang Xia, Esq.

(57) ABSTRACT

The present invention discloses an electrical connector and an electrical connector assembly. Each of the ground terminals is provided to be in contact with two corresponding first mating terminals in a left-right direction. The terminals may mate with the first and second mating terminals under the same specification, thus facilitating unified automatic production of the mating connector, and may achieve the objectives for increasing the shielding effect of the electrical connector and saving the quantity of the terminals without changing the size of the electrical connector.

20 Claims, 16 Drawing Sheets

A-A

B-B

C-C

F–F

G–G

ELECTRICAL CONNECTOR AND ELECTRICAL CONNECTOR ASSEMBLY

CROSS-REFERENCE TO RELATED PATENT APPLICATION

This non-provisional application claims priority to and the benefit of, pursuant to 35 U.S.C. § 119(a), patent application Serial No. CN202020570911.9 filed in China on Apr. 16, 2020, and patent application Serial No. CN202021770668.1 filed in China on Aug. 21, 2020. The disclosure of each of the above applications is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and an electrical connector assembly, and particularly to an electrical connector and an electrical connector assembly capable of increasing high frequency effects.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing connector system used to be connected to a circuit board, such as Chinese Patent CN110707493, discloses an adapter electrical connector for conducting two circuit boards by connecting a first connector and a second connector. The adapter connector includes a plate body and a plurality of signal terminals and a plurality of ground terminals provided in the plate body and arranged in a plurality of rows. In each row, the ground terminals and a plurality of signal terminal pairs formed by the signal terminals are provided alternately. To achieve the ideal high frequency requirements, a width of each ground terminal needs to be widened, and a width of each of the ground contacts correspondingly connected to the ground terminals on the first connector and the second connector also needs to be widened correspondingly, such that after the adapter connector is mated with the first and second connectors, the ground terminals and the ground contacts are conductively connected to provide electrical shielding for the signal terminals. To further reduce the crosstalk between the signal terminals, shielding plate members are provided in front of and behind each row of the terminals for covering, thereby achieving and increasing the shielding effect between the signal terminal pairs. However, the connector system has the following deficiencies: with the increasing high frequency requirements of the connector system, the arrangement density of the terminals of the adapter electrical connector of the connector system increases, and the transmission path of each terminal is prolonged, resulting in the length of each terminal to be longer. Thus, merely relying upon the shielding plate members inserted and provided between the rows of terminals does not solve the crosstalk issue generated during the signal transmission. If additional shielding members are provided on the signal terminal pairs, it may be difficult for assembly due to the limitation of the dense arrangement of the terminals. In addition, the width of each ground terminal is different from the width of each signal terminal, resulting in the width of each ground contact to be different from the width of each signal contact, which is not convenient for mass unified production. Further, in the adapter electrically connector, the ground terminals are alternately inserted between the signal terminal pairs, and each ground terminal has a wider width and thus occupies more mounting space. If the intervals between the terminals are reduced, the signal interference between the signal terminals may increase, thus reducing the electrical characteristics of the connector system. If the length of each row of terminals is increased in order to maintain the intervals between the terminals, the connector system may have a larger size, which cannot satisfy the ultra-thin requirement of the existing connector system.

Therefore, a heretofore unaddressed need to design a novel electrical connector and an electrical connector assembly exists in the art to address the aforementioned deficiencies and inadequacies.

SUMMARY

The present invention is directed to an electrical connector and an electrical connector assembly, in which each of the ground terminals is provided to be in contact with two corresponding first mating terminals in a left-right direction, thus achieving the objectives for increasing the shielding effect of the electrical connector and saving the quantity of the terminals without changing the size of the electrical connector.

To achieve the foregoing objective, the present invention adopts the following technical solutions.

An electrical connector is configured to mate with a mating connector along a vertical direction. The mating connector includes two rows of first mating terminals and two rows of second mating terminals, each of the two rows of first mating terminals and each of the two rows of second mating terminals are arranged along a front-rear direction. The electrical connector includes: a row of ground terminals arranged along the front-rear direction, wherein the ground terminals and the first mating terminals are provided in the vertical direction, each of the ground terminals has a retaining portion in a flat plate shape, each of a front surface and a back surface of the retaining portion is a plate surface, and each of the ground terminals is in contact with two corresponding first mating terminals of the first mating terminals in a left-right direction; and two rows of signal terminals, wherein each of the two rows of signal terminals are arranged along the front-rear direction, the signal terminals and the second mating terminals are provided in the vertical direction, each of the signal terminals is one-to-one in contact with a corresponding one of the second mating terminals, and a location of each of the signal terminals in contact with the corresponding one of the second mating terminals and a location of each of the ground terminal in contact with the two corresponding first mating terminals are of a same height.

In certain embodiments, each of the signal terminals is in contact with the corresponding one of the second mating terminals along the front-rear direction, and one of a front surface and a back surface of each of the ground terminals is in contact with the two corresponding first mating terminals in the left-right direction.

In certain embodiments, the electrical connector further includes a row of insulating blocks arranged along the front-rear direction, wherein each of the insulating blocks is located between and clamped by the retaining portions of two of the ground terminals adjacent to each other in the front-rear direction, and the signal terminals are retained in the insulating blocks.

In certain embodiments, each of the signal terminals is in contact with the corresponding one of the second mating terminals along the left-right direction, and each of the ground terminals is clamped by the two corresponding first mating terminals in the left-right direction.

In certain embodiments, the mating connector is provided with an insulating body retaining the first mating terminals and the second mating terminals, each row of the two rows of signal terminals is fixed in an insulating block, one of an upper end and a lower end of the retaining portion is stopped by the insulating block, and the other of the upper end and the lower end of the retaining portion is stopped by the insulating body, such that the insulating block and the insulating body limit the retaining portion from moving vertically.

In certain embodiments, each of the ground terminals has a grounding portion, the grounding portion is in contact with the two corresponding first mating terminals in the left-right direction, each of a front surface and a back surface of the grounding portion is a plate surface, and a width of the retaining portion along the left-right direction is greater than a width of the grounding portion along the left-right direction.

In certain embodiments, the retaining portion is provided with a clamping slot, a shielding plate is clamped in the clamping slot, the shielding plate is located between the two rows of signal terminals in the left-right direction, and each of a left surface and a right surface of the shielding plate is a plate surface.

In certain embodiments, the electrical connector further includes an insulating outer frame, wherein an inner side surface of the insulating outer frame is provided with a plurality of fixing slots, two clamping arms are provided respectively at a front side and a back side of the shielding plate, a side edge of each of the two clamping arms is provided with a protruding sheet and a protruding hook, the clamping arms are accommodated in the fixing slots, each of the fixing slots is provided with a fixing concave portion to correspondingly clamp the protruding sheet of a corresponding one of the clamping arms, and each of the fixing slots is provided with a fixing protruding portion to correspondingly clamp the protruding hook of the corresponding one of the clamping arms.

An electrical connector assembly includes: a mating connector, comprising two rows of first mating terminals and two rows of second mating terminals, wherein each of the two rows of first mating terminals and each of the two rows of second mating terminals are arranged along a front-rear direction, each of the first mating terminals is provided with a first contact portion, each of the second mating terminals is provided with a second contact portion, and the first contact portion and the second contact portion are of a same height; and an electrical connector, configured to mate with a mating connector along a vertical direction. The electrical connector includes: a row of ground terminals arranged along the front-rear direction, wherein the ground terminals and the first mating terminals are provided in the vertical direction, each of the ground terminals has a retaining portion in a flat plate shape, each of a front surface and a back surface of the retaining portion is a plate surface, and each of the ground terminals is in contact with the first contact portions of two corresponding first mating terminals of the first mating terminals in a left-right direction; and two rows of signal terminals, wherein each of the two rows of signal terminals are arranged along the front-rear direction, the signal terminals and the second mating terminals are provided in the vertical direction, each of the signal terminals has a first mating portion, and the first mating portion is one-to-one in contact with the second contact portion of a corresponding one of the second mating terminals.

In certain embodiments, the first mating portion is in contact with the second contact portion of the corresponding one of the second mating terminals along the front-rear direction, and one of a front surface and a back surface of each of the ground terminals is in contact with the first contact portions of the two corresponding first mating terminals in the left-right direction.

In certain embodiments, the electrical connector assembly further includes a row of insulating blocks arranged along the front-rear direction, wherein each of the insulating blocks is located between and clamped by the retaining portions of two of the ground terminals adjacent to each other in the front-rear direction, and the signal terminals are retained in the insulating blocks.

In certain embodiments, the first mating portions of the two rows of signal terminals are located between the two second contact portions of the two rows of second mating terminals, the first mating portion of each of the signal terminals is in contact with the second contact portion of the corresponding one of the second mating terminals along the left-right direction, and each of the ground terminals is clamped by the first contact portions of the two corresponding first mating terminals in the left-right direction.

In certain embodiments, the mating connector is provided with an insulating body retaining the first mating terminals and the second mating terminals, each row of the two rows of signal terminals is fixed in an insulating block, one of an upper end and a lower end of the retaining portion is stopped by the insulating block, and the other of the upper end and the lower end of the retaining portion is stopped by the insulating body, such that the insulating block and the insulating body limit the retaining portion from moving vertically.

In certain embodiments, the first mating terminals and the second mating terminals are arranged to align in the front-rear direction, the mating connector is provided with a metal sheet extending along the front-rear direction between the two rows of first mating terminals, and a plurality of conductive portions are protrudingly provided at a left side and a right side of the metal sheet to be in contact with the corresponding two rows of first mating terminals.

In certain embodiments, the mating connector is provided with an insulating body, each of the first mating terminals is provided with a positioning portion retained in the insulating body, and the retaining portion of each of the ground terminals vertically overlaps with the positioning portion of each of the two corresponding first mating terminals.

In certain embodiments, a plate surface of the first mating portion of each of the signal terminals is in contact with a plate surface of the second contact portion of the corresponding one of the second mating terminals, and each of the first mating terminals and each of the second mating terminals have identical structures.

In certain embodiments, the electrical connector assembly further includes another mating connector, wherein the mating connector and the another mating connector are located at an upper side and a lower side of the electrical connector, the another mating connector comprises two rows of third mating terminals and two rows of fourth mating terminals, each row of the two rows of third mating terminals and each row of the two rows of fourth mating terminals are arranged along the front-rear direction, each of the third mating terminals is provided with a third contact portion, each of the fourth mating terminals is provided with a fourth contact portion, the third contact portion and the fourth contact portion are of a same height, each of the ground terminals is in contact with the third contact portions of two corresponding first mating terminals of the first mating terminals in the left-right direction, each of the signal terminals is provided with a second mating portion, the second mating portion is one-to-one in contact with the fourth contact portion of a corresponding one of the fourth mating terminals, an upper end of each of the ground terminals passes upward beyond an upper end of each of the signal terminals, a lower end of each of the ground terminals passes upward beyond a lower end of each of the signal terminals, and the upper end and the lower end of each of the ground terminals enter the mating connector and the another mating connector.

In certain embodiments, the electrical connector comprises a plurality of upper insulating blocks and a plurality of lower insulating blocks, each of the signal terminals comprises an upper retaining section retained in a corresponding one of the upper insulating blocks, a lower retaining section retained in a corresponding one of the lower insulating blocks, and a connecting section connecting the upper retaining section and the lower retaining section and exposed to the corresponding one of the upper insulating blocks and the corresponding one of the lower insulating blocks, and an upper end of the retaining portion is upward stopped by the corresponding one of the upper insulating blocks.

In certain embodiments, the retaining portion is provided with a clamping slot, a shielding plate is clamped in the clamping slot, the shielding plate is located between the two rows of signal terminals in the left-right direction, each of a left surface and a right surface of the shielding plate is a plate surface, the plate surfaces of the shielding plate is protrudingly provided with a plurality of elastic sheets, and the elastic sheets downward abut the corresponding one of the lower insulating blocks.

In certain embodiments, each of the ground terminals has a grounding portion, the grounding portion is in contact with the first contact portions of the two corresponding first mating terminals in the left-right direction, each of a front surface and a back surface of the grounding portion is a plate surface, and a width of the retaining portion along the left-right direction is greater than a width of the grounding portion along the left-right direction.

Compared with the related art, in certain embodiments of the present invention, each of the ground terminals is provided to be in contact with two corresponding first mating terminals in a left-right direction. The terminals may mate with the first and second mating terminals under the same specification, thus facilitating unified automatic production of the mating connector, and may achieve the objectives for increasing the shielding effect of the electrical connector and saving the quantity of the terminals without changing the size of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
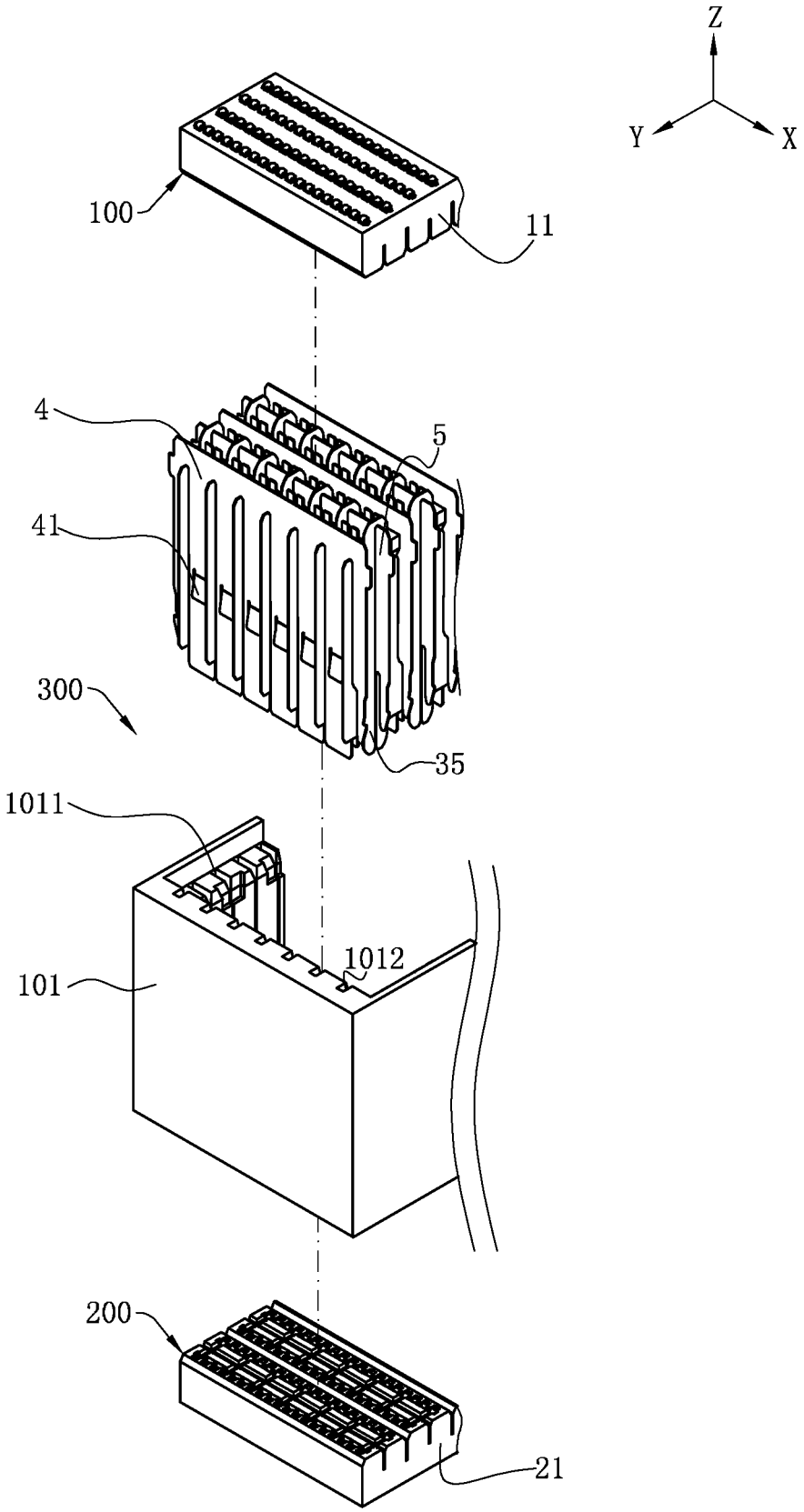
FIG. 1 is a perspective view of an electrical connector according to a first embodiment of the present invention, which is not mated with an upper mating connector and a lower mating connector.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "center," "upper" or "top," "lower" or "bottom," "left," "right," "vertical," "horizontal," "inner" or "outer" may be used herein to describe one element's directional or positional relationship to another element as illustrated in the Figures. It will be understood that the relative terms are used to describe the features of certain embodiments of the invention, and not to indicate or imply a required directional or positional relationship between the elements. Thus, the relative terms are not intended to limit the scope of all aspects of the invention. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-15. In accordance with the purposes of this invention, as embodied and broadly described herein, this invention, in one aspect, relates to an electrical connector and an electrical connector assembly.

FIG. 1 to FIG. 10 show a first embodiment of the present invention. The electrical connector assembly includes an upper mating connector 100 and a lower mating connector 200 provided opposite to each other, and an electrical connector 300 located between and electrically connecting the upper mating connector 100 and the lower mating connector 200. (In other embodiments, it is possible to provide only one of the upper mating connector 100 and the lower mating connector 200, and the electrical connector 300 is only electrically connected to the one of the upper mating connector 100 and the lower mating connector 200.)

For convenience of understanding the drawings, a forward direction in a front-rear direction is defined as the positive direction of the X-axis, a leftward direction in a left-right direction is defined as the positive direction of the Y-axis, and an upward direction in a vertical direction is defined as the positive direction of the Z-axis. As shown in FIG. 1, FIG. 2, FIG. 3 and FIG. 9, the upper mating connector 100 includes an upper insulating body 11, and a plurality of first mating terminals 12 and a plurality of second mating terminals 13 retained in the upper insulating body 11. The first mating terminals 12 are used for providing grounding functions, and the second mating terminals 13 are used for providing signal transmission functions. An upper mating terminal group P is formed by an arrangement in a successive sequential order of one first mating terminal 12 and two second mating terminals 13 in one row and aligning along the front-rear direction. In other embodiments, the first mating terminals 12 and the second mating terminals 13 may be provided not to align in the front-rear direction. Multiple upper mating terminal groups P are arranged along the left-right direction. In two adjacent upper mating terminal groups P, each of the first mating terminals 12 aligns in the left-right direction, and each of the second mating terminals 13 aligns in the left-right direction. Each first mating terminal 12 has an upper positioning portion m in a flat plate shape and retained in the upper insulating body 11, and a first contact portion 121 bending and extending downward from the upper positioning portion m. Each second mating terminal 13 has a second contact portion 131 bending and extending downward. The first contact portion 121 and the second contact portion 131 are of the same height. Each of a left surface and a right surface of each of the upper positioning portion m, the first contact portion 121 and the second contact portion 131 is a plate surface. An upper end portion of each of the first mating terminals 12 and the second mating terminals 13 is fixed and provided with a solder ball to be soldered to an upper circuit board (not shown). In this embodiment, the first mating terminals 12 and the second mating terminals 13 have identical structures. In other embodiments, the structures of the first mating terminals 12 and the second mating terminals 13 may be different.

Figure 7:
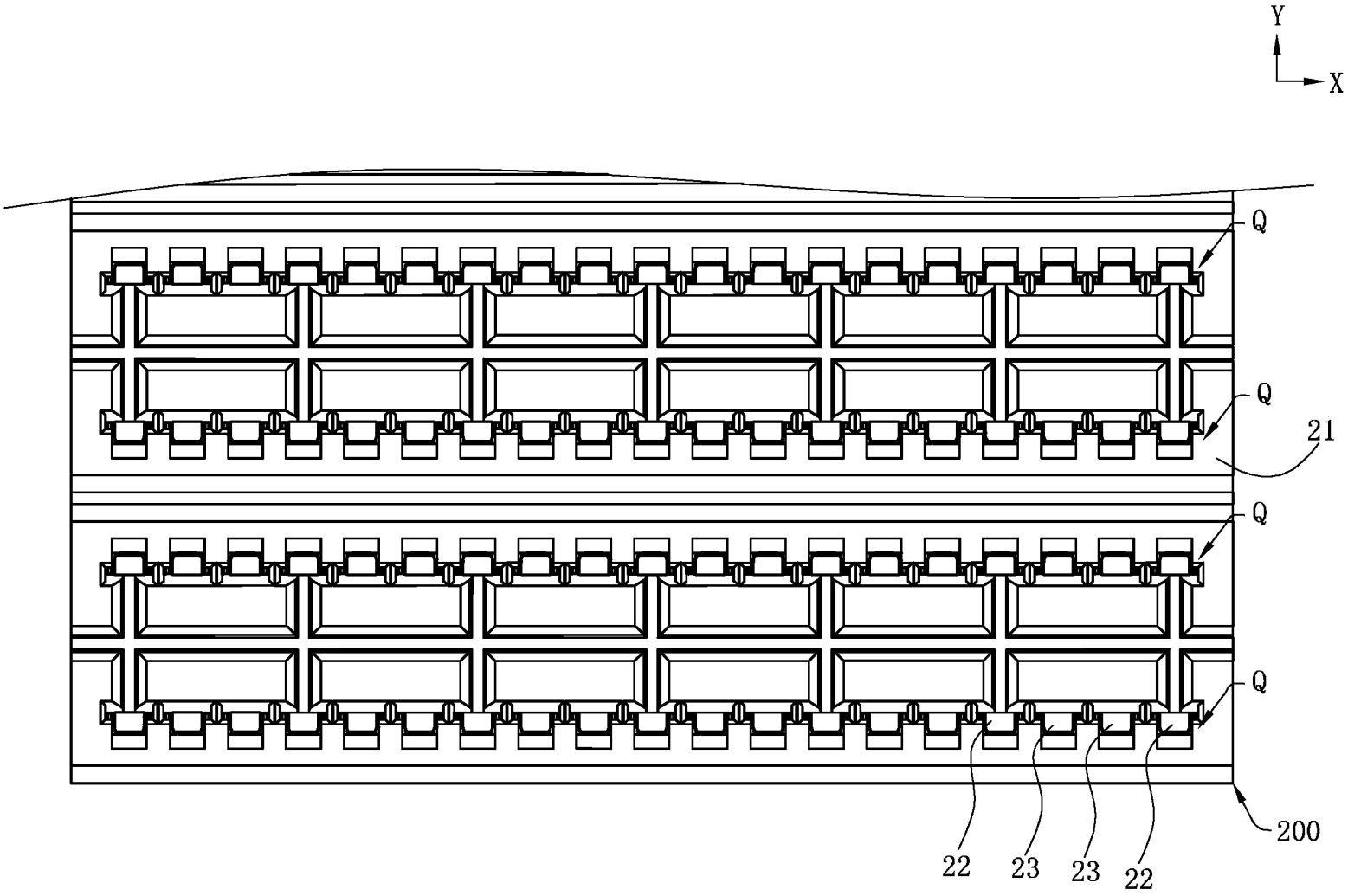
FIG. 7 is a top view of the lower mating connector according to the first embodiment of the present invention.
Figure 8:
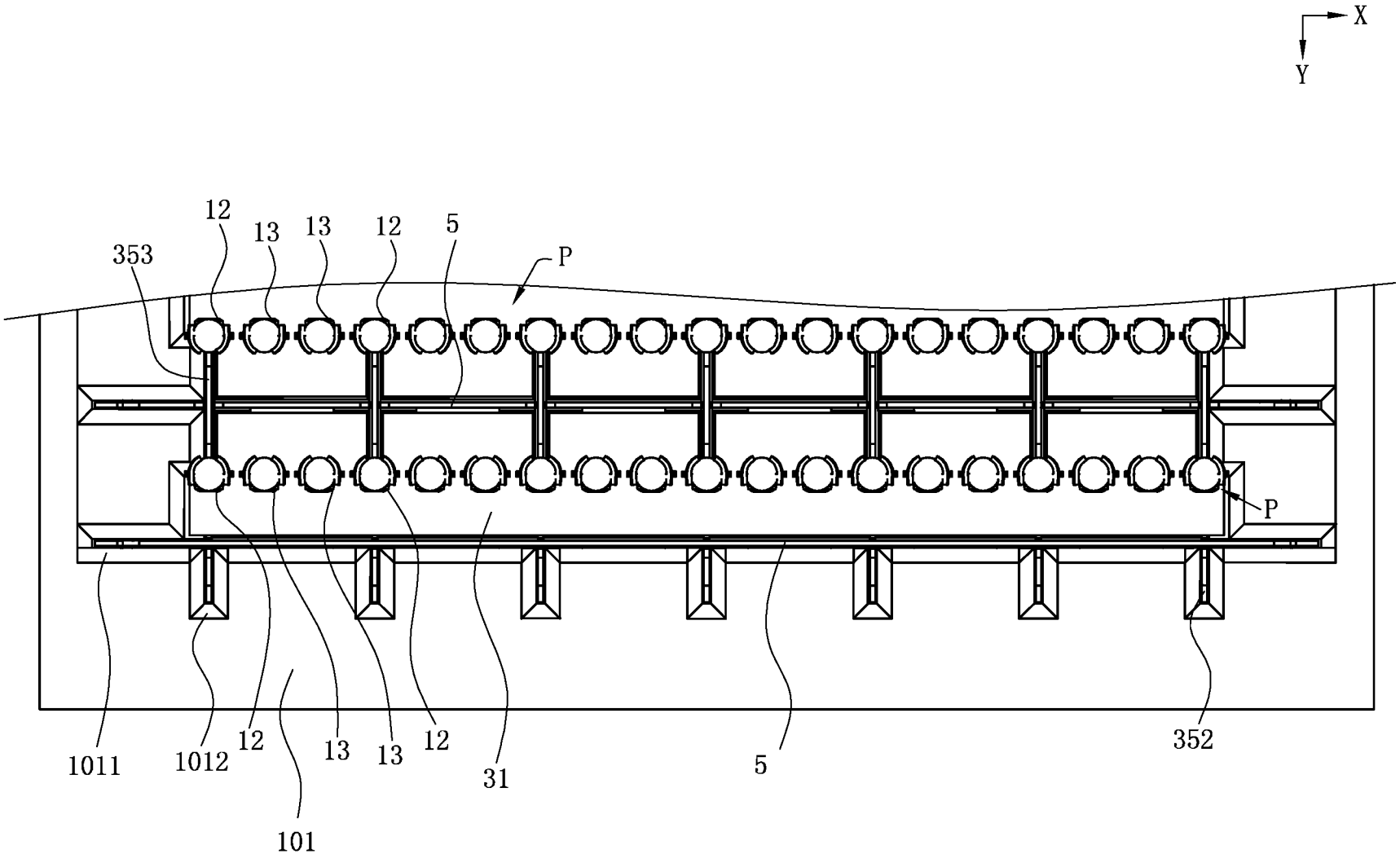
FIG. 8 is a top view of the upper grounding portions mated with the first mating terminals according to the first embodiment of the present invention.
Figure 9:
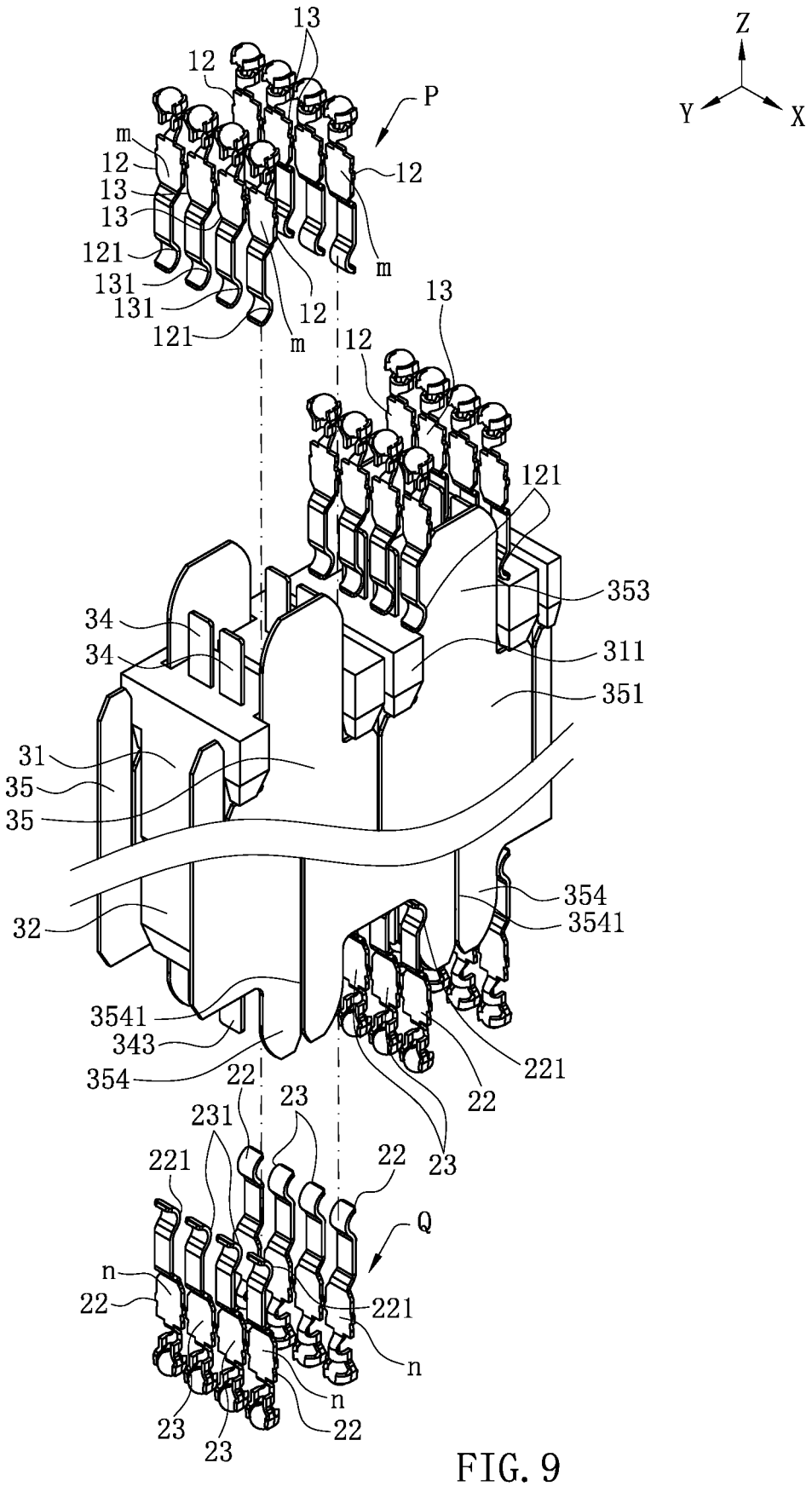
FIG. 9 is a perspective view of the ground terminals partially mated with the first and third mating terminals according to the first embodiment of the present invention.
Figure 10:
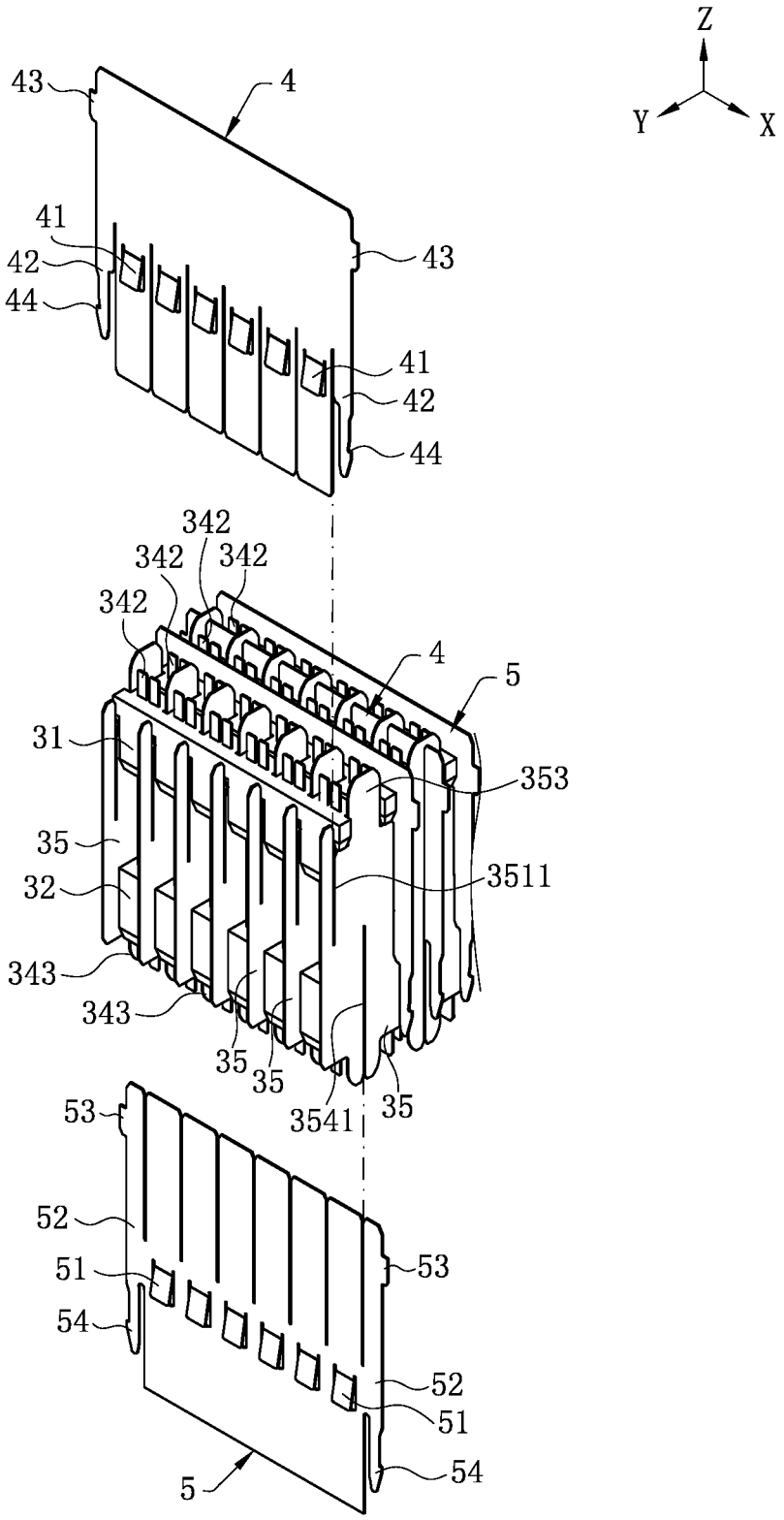
FIG. 10 is a perspective view of the first shielding plate and the second shielding plate inserted with the ground terminals according to the first embodiment of the present invention.
Figure 11:
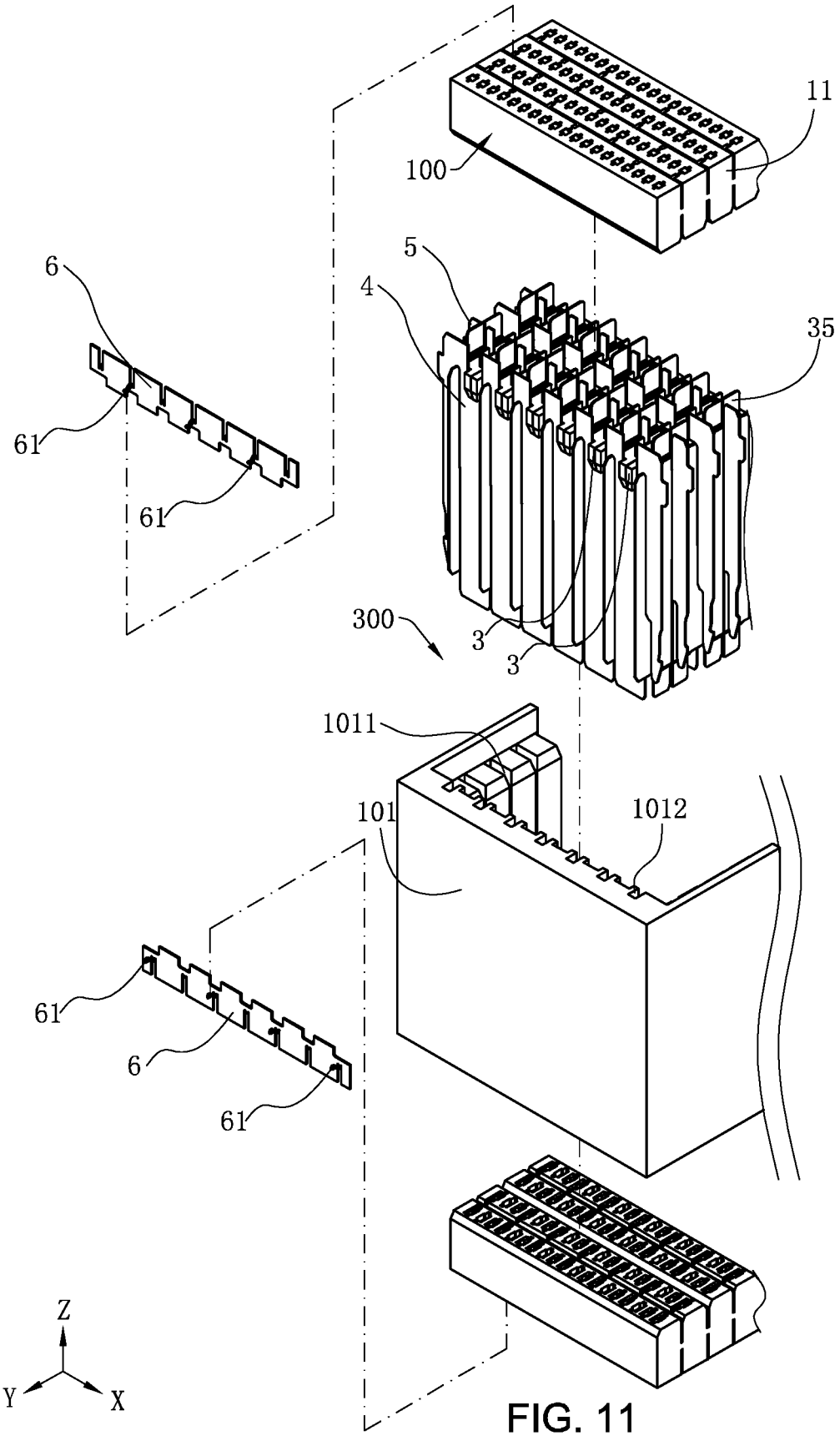
FIG. 11 is a perspective view of an electrical connector according to a second embodiment of the present invention, which is not mated with an upper mating connector and a lower mating connector.
Figure 12:
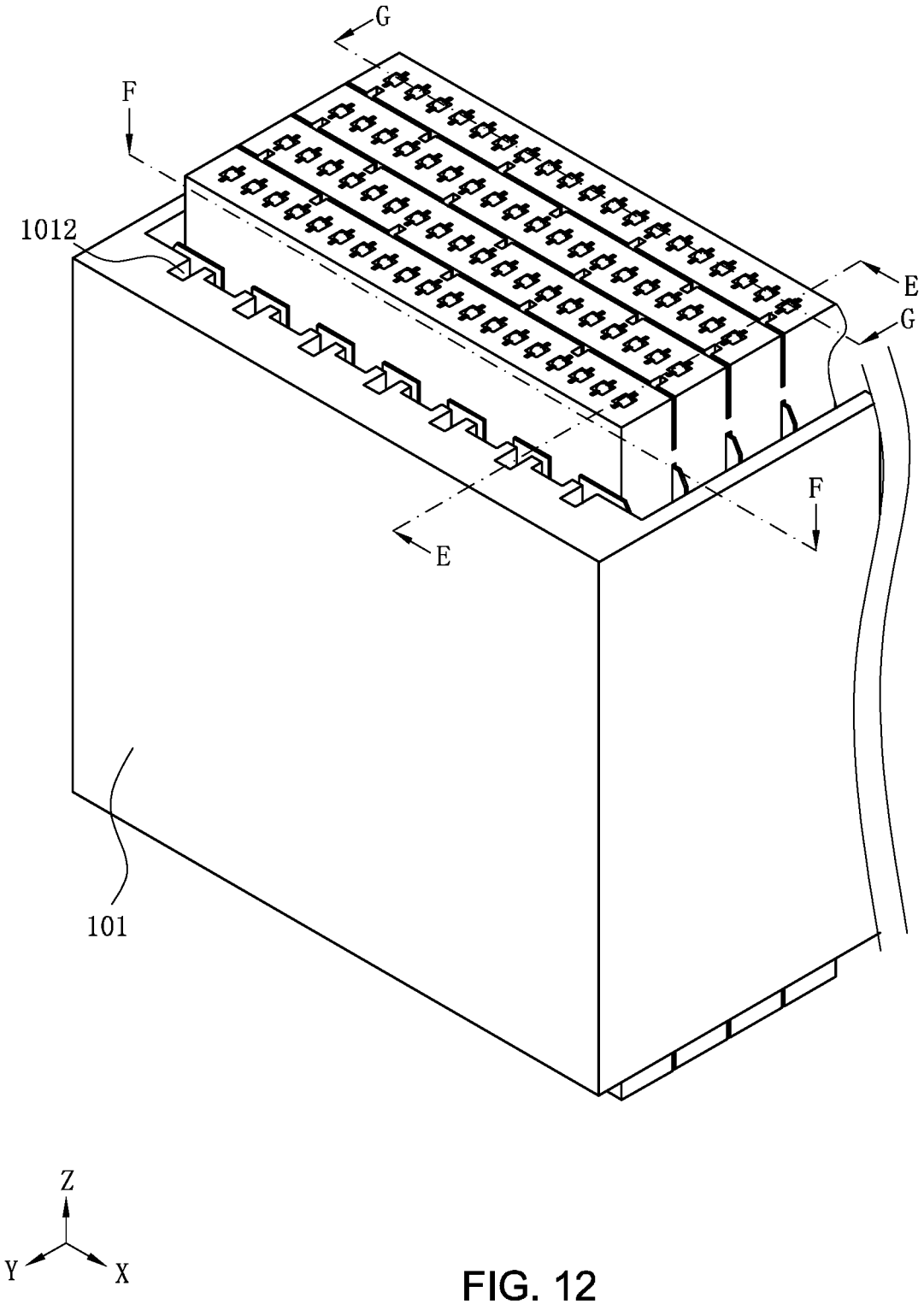
FIG. 12 is a perspective view of the electrical connector according to the second embodiment of the present invention, which is mated with the upper mating connector and the lower mating connector.
Figure 13:
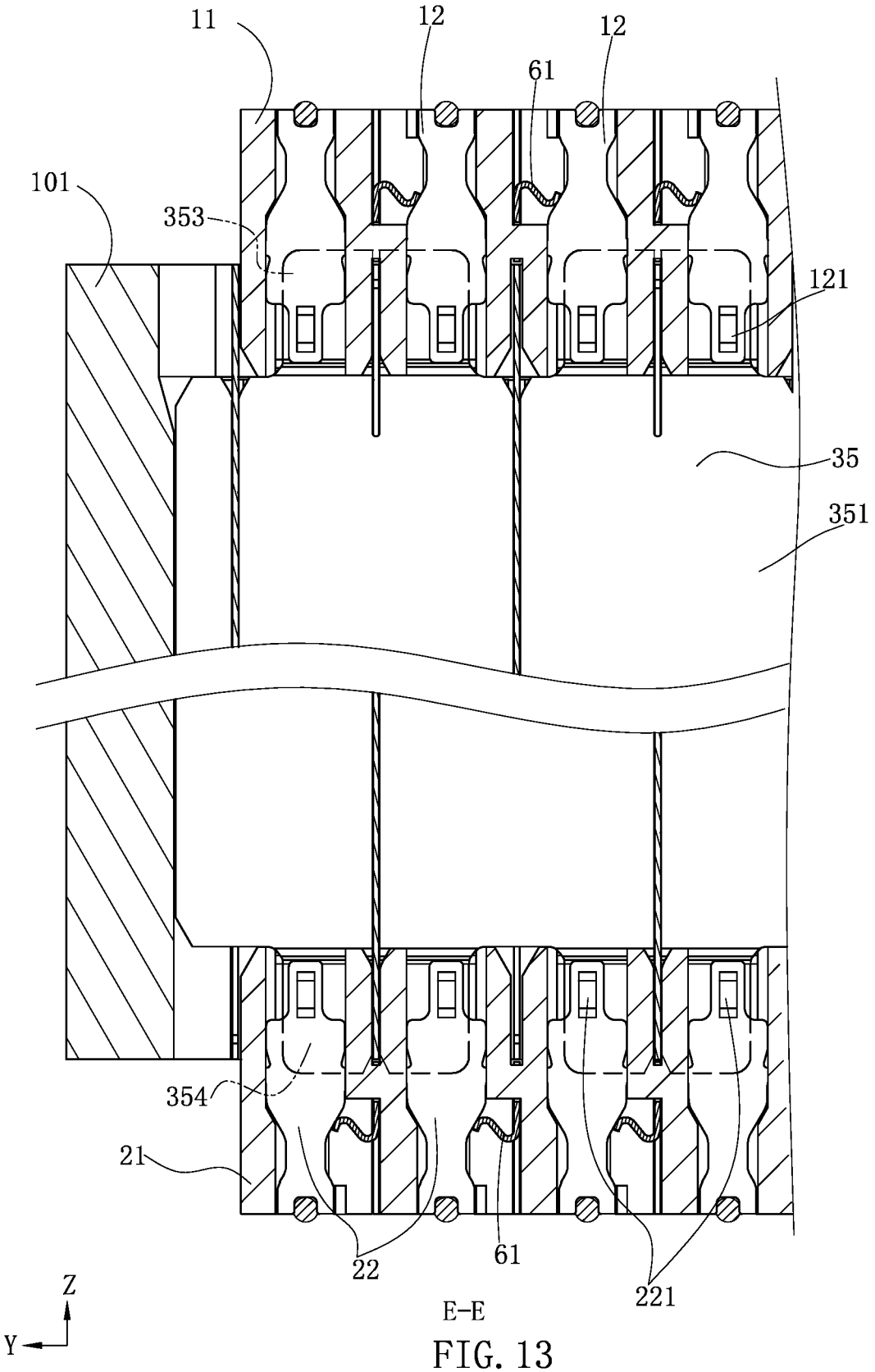
FIG. 13 is a sectional view of FIG. 12 along line E-E.
Figure 14:
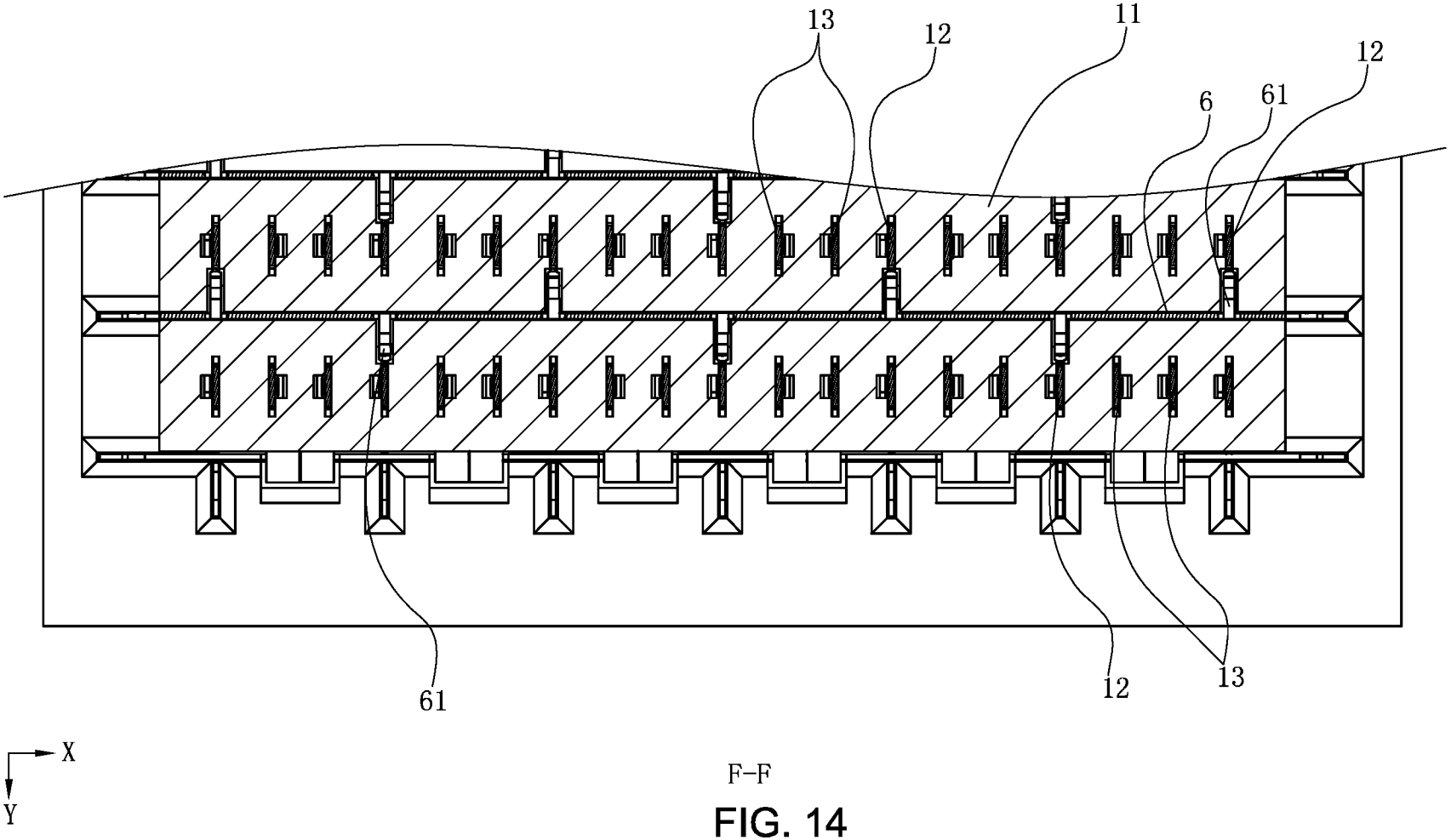
FIG. 14 is a sectional view of FIG. 12 along line F-F.
Figure 15:
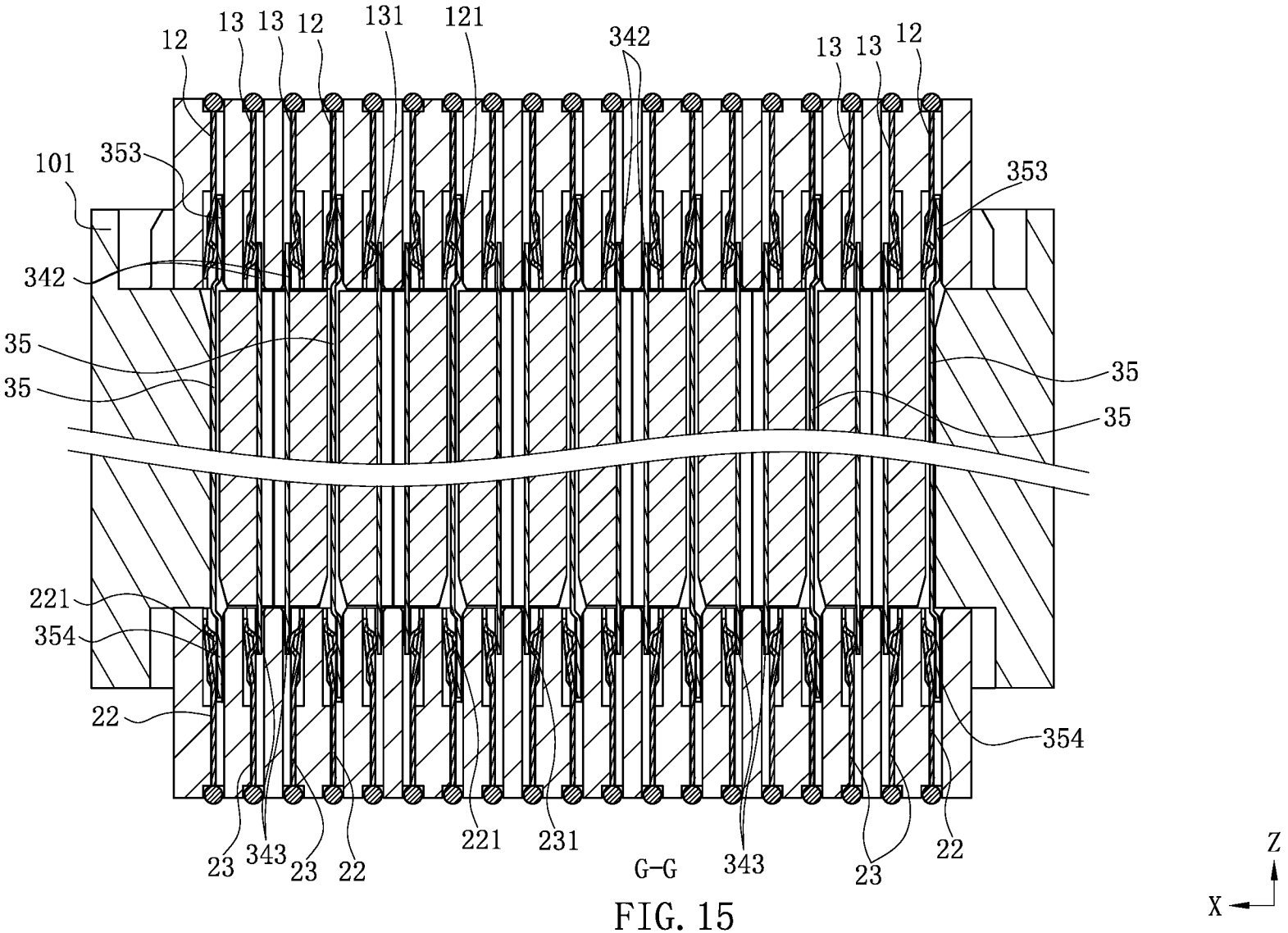
FIG. 15 is a sectional view of FIG. 12 along line G-G.
Figure 16:
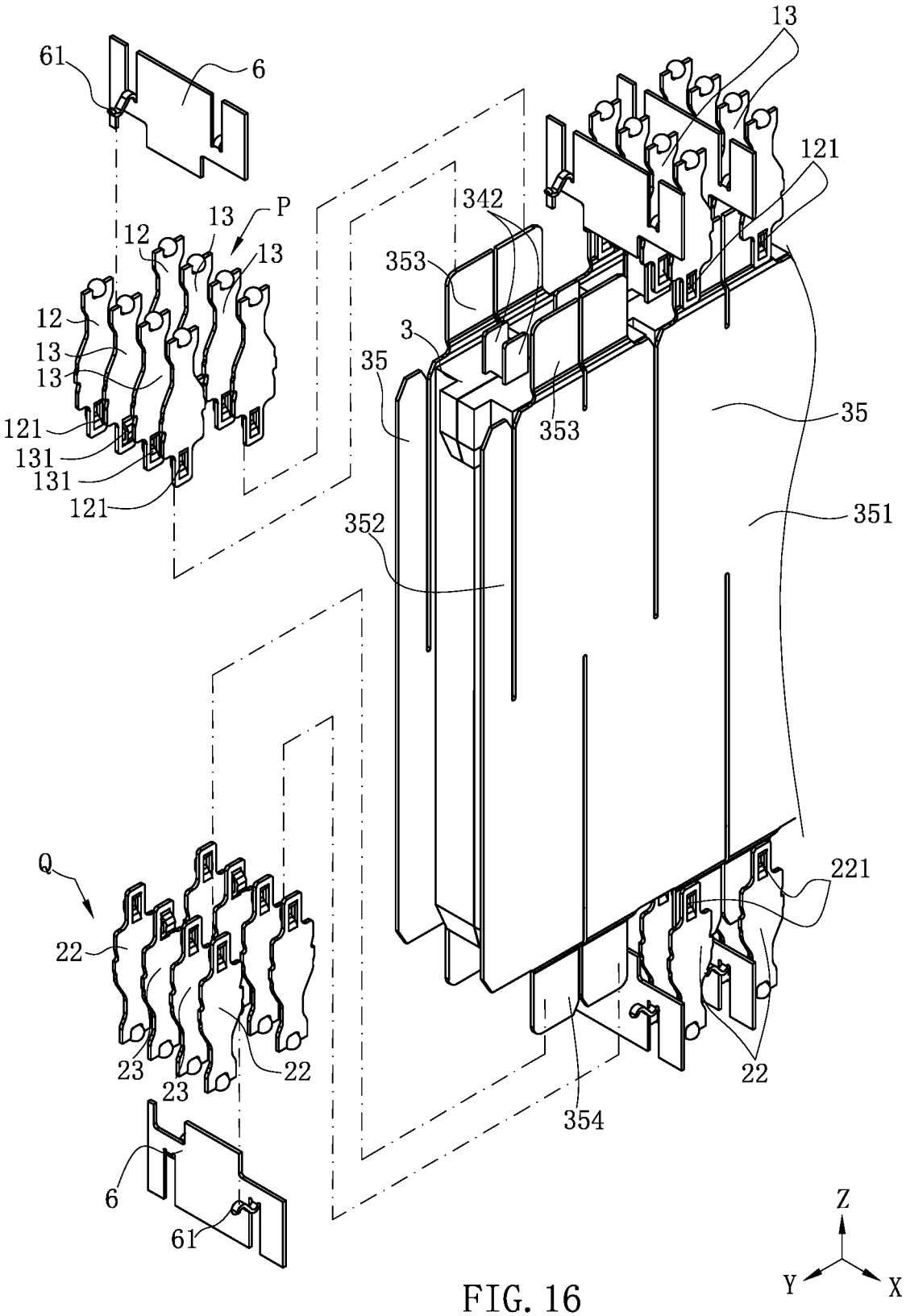
FIG. 16 is a perspective view of the ground terminals partially mated with the first and third mating terminals according to the second embodiment of the present invention.

As shown in FIG. 1, FIG. 7 and FIG. 9, the lower mating connector 200 includes a lower insulating body 21, and a plurality of third mating terminals 22 and a plurality of fourth mating terminals 23 retained in the lower insulating body 21. The third mating terminals 22 are used for providing grounding functions, and the fourth mating terminals 23 are used for providing signal transmission functions. A lower mating terminal group Q is formed by an arrangement in a successive sequential order of one third mating terminal 22 and two fourth mating terminals 23 in one row and aligning along the front-rear direction. In other embodiments, the third mating terminals 22 and the fourth mating terminals 23 may be provided not to align in the front-rear direction. Multiple lower mating terminal groups Q are arranged along the left-right direction. In two adjacent lower mating terminal groups Q, each of the third mating terminals 22 aligns in the left-right direction, and each of the fourth mating terminals 23 aligns in the left-right direction. Each third mating terminal 22 has a lower positioning portion n retained in the lower insulating body 21, and a third contact portion 221 bending and extending upward from the lower positioning portion n. Each fourth mating terminal 23 has a fourth contact portion 231 bending and extending upward. The third contact portion 221 and the fourth contact portion 231 are of the same height. A lower end portion of each of the third mating terminals 22 and the fourth mating terminals 23 is fixed and provided with a solder ball to be soldered to a lower circuit board (not shown). In this embodiment, the third mating terminals 22 and the fourth mating terminals 23 have identical structures, and the upper mating connector 100 and the lower mating connector 200 have identical structures. In other embodiments, the structures of the first mating terminals 12 and the second mating terminals 13 may be different, and the structures of the upper mating connector 100 and the lower mating connector 200 may be different.

Figure 3:
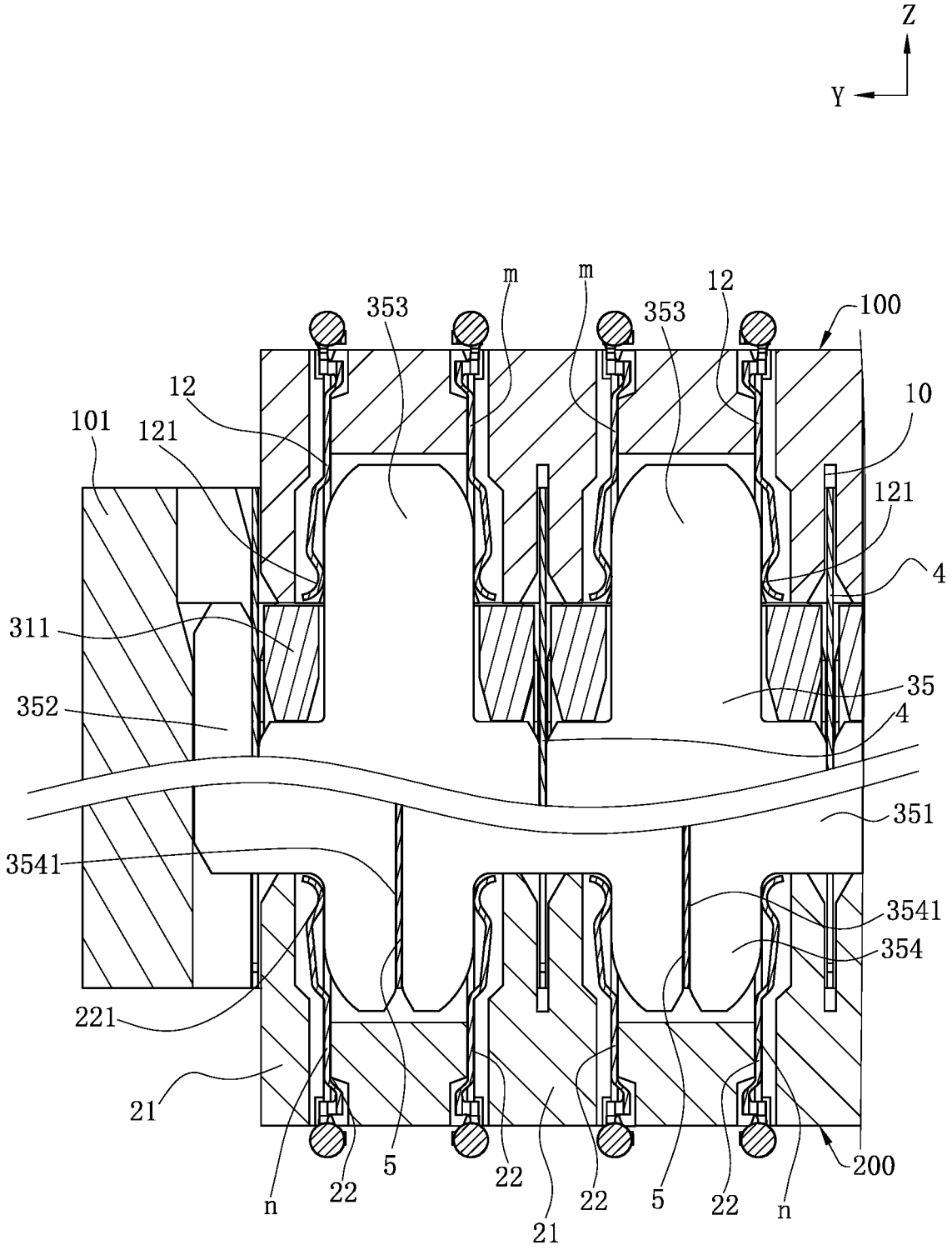
FIG. 3 is a sectional view of FIG. 2 along line A-A.
Figure 5:
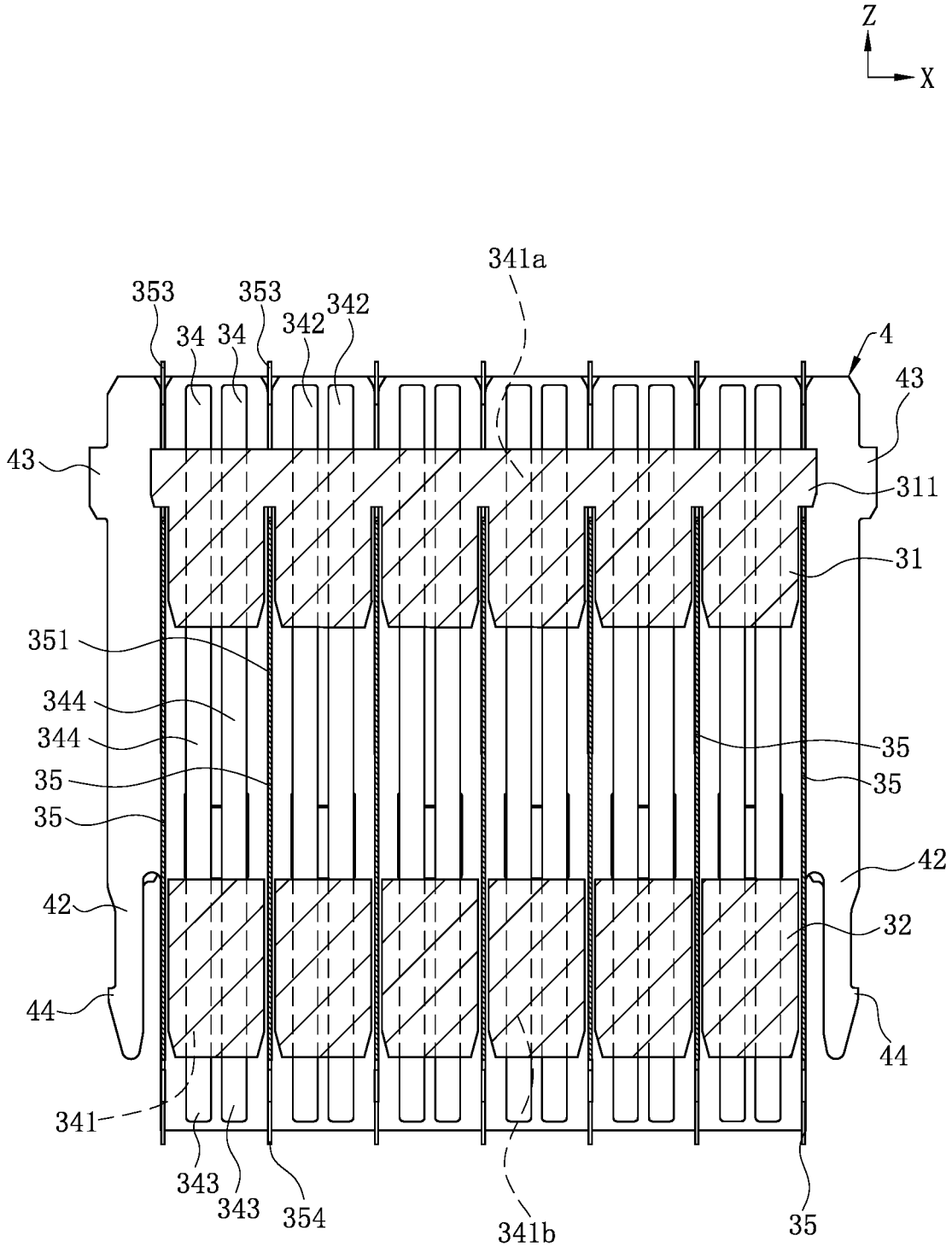
FIG. 5 is a sectional view of FIG. 2 along line C-C after removing the insulating shell.
Figure 6:
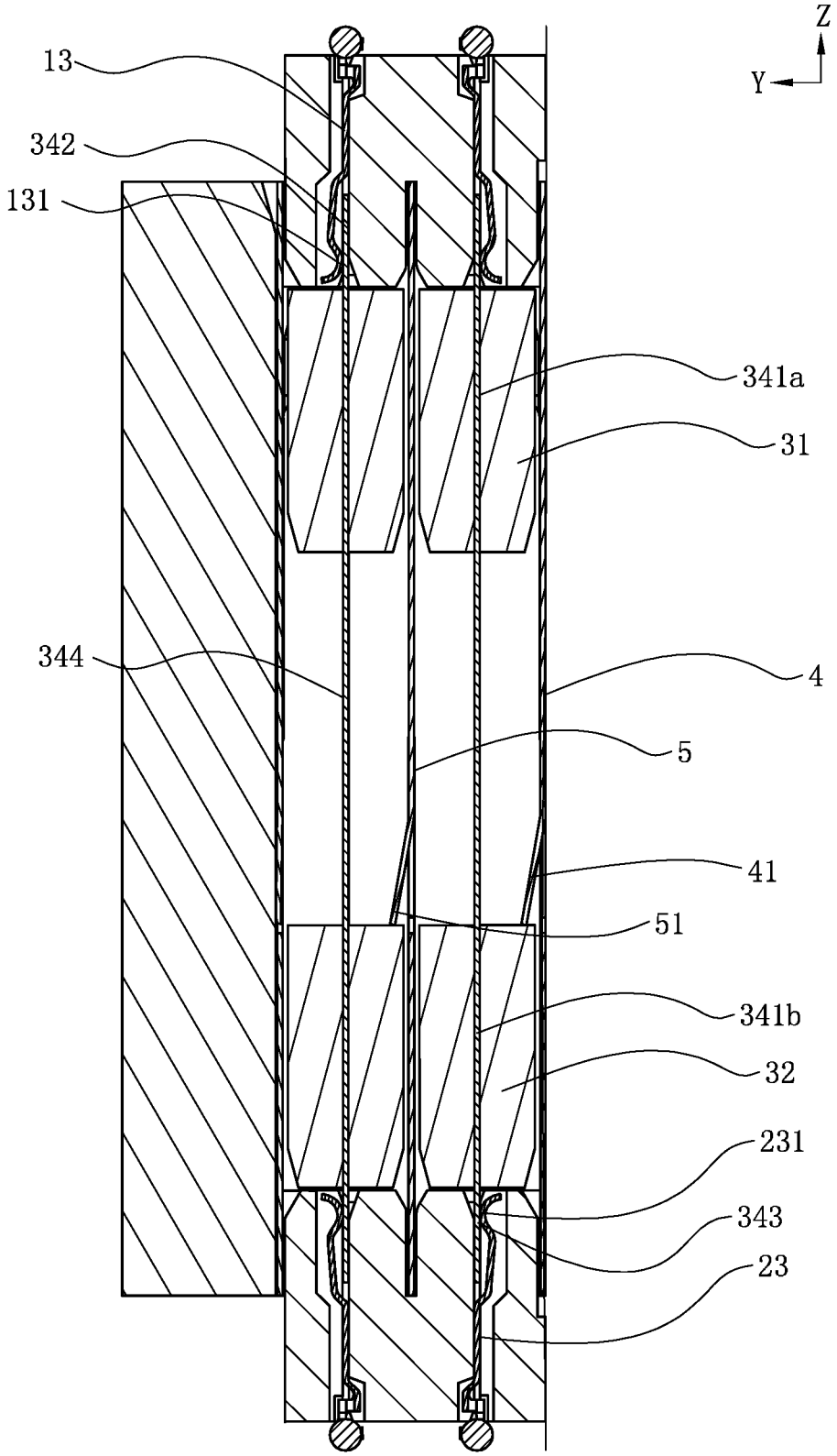
FIG. 6 is a sectional view of FIG. 2 along line D-D after removing the insulating shell.

As shown in FIG. 3, FIG. 5 and FIG. 6, the electrical connector 300 includes a plurality of upper insulating blocks 31 arranged along the left-right direction and a plurality of lower insulating blocks 32 located below the upper insulating blocks 31, and a plurality of signal terminals 34 arranged along the front-rear direction and fixed to the upper insulating blocks 31 and the lower insulating blocks 32. In this embodiment, the signal terminals 34 are injection molded to the upper insulating blocks 31 and the lower insulating blocks 32. In other embodiments, the signal terminals 34 may be fixed to the upper insulating blocks 31 and the lower insulating blocks 32 by insertion or other methods, and is thus not hereinafter limited thereto. Each row of the signal terminals 34 is fixed to a corresponding one of the upper insulating blocks 31. Each of a left surface and a right surface of each signal terminal 34 is a plate surface, and a front surface and a back surface of each signal terminal 34 are plate edges. Each signal terminal 34 includes an upper retaining section 341*a* retained in the corresponding upper insulating block 31 and a lower retaining section 341*b* retained in a corresponding lower insulating block 32. A first mating portion 342 is connected to the upper retaining section 341*a* and protrudes above the corresponding upper insulating block 31. Two rows of the first mating portions 342 of the signal terminals 34 are located between two rows of the second contact portions 131 of the second mating terminals 13, and the first mating portions 342 of the signal terminals 34 are one-to-one in contact with the second contact portions 131 of the second mating terminals 13 along the left-right direction to facilitate electrical conduction. A second mating portion 343 is connected to the lower retaining section 341*b* and protrudes below the corresponding lower insulating block 32. Two rows of the second mating portions 343 of the signal terminals 34 are located between two rows of the fourth contact portions 231 of the fourth mating terminals 23, and the second mating portions 343 of the signal terminals 34 are one-to-one in contact with the fourth contact portions 231 of the fourth mating terminals 23 along the left-right direction to facilitate electrical conduction. A connecting section 344 is vertically connected between the upper retaining section 341*a* and the lower retaining section 341*b*, and is exposed between the corresponding upper insulating block 31 and the corresponding lower insulating block 32.

As shown in FIG. 3 and FIG. 9, a plurality of ground terminals 35 extend along the left-right direction and are retained to the upper insulating blocks 31 and the lower insulating blocks 32, and are arranged in a successive sequential order of one ground terminal 35 and two signal terminals 34 and aligning along the front-rear direction. Each ground terminal 35 includes a retaining portion 351, a plurality of upper grounding portions 353 connected to an upper end of the retaining portion 351, and a plurality of lower grounding portions 354 connected to a lower end of the retaining portion 351. The retaining portion 351 of each ground terminal 35 vertically overlaps with the upper positioning portion m of the corresponding first mating terminal 12 and the lower positioning portion n of the corresponding third mating terminal 22. Each ground terminal 35 is in a flat plate shape, and each of a front surface and a back surface of each of the retaining portion 351, the upper grounding portion 353 and the lower grounding portion 354 is a plate surface. The retaining portions 351 of the ground terminals 35 are retained to the upper insulating blocks 31 and the lower insulating blocks 32. In addition, a protruding block 311 protrudes forward from a front end surface of each upper insulating block 31. The protruding block 311 is located at an upper end of the retaining portion 351 of a corresponding ground terminal 35, thereby stopping the retaining portion 351 from moving upward. The retaining portion 351 of each ground terminal 35 shields the connecting section 344, the upper retaining section 341*a* and the lower retaining section 341*b* of a corresponding signal terminal 34 along the front-rear direction. A width of the retaining portion 351 along the left-right direction is greater than a width of each upper grounding portion 353 and each lower grounding portion 354 along the left-right direction. The upper grounding portion 353 protrudes out above the corresponding upper insulating block 31. When the electrical connector 300 is mated with the upper mating connector 100, as shown in FIG. 3 and FIG. 9, each upper grounding portion 353 is located between two corresponding first mating terminals 12 and elastically clamped by two corresponding first contact portions 121. The lower grounding portion 354 protrudes out below the corresponding lower insulating block 32. When the electrical connector 300 is mated with the lower mating connector 200, each lower grounding portion 354 is located between two corresponding third mating terminals 22 and elastically clamped by two corresponding third contact portions 221, thereby facilitating electrical conduction of each ground terminal 35 with the corresponding first mating terminals 12 and the corresponding third mating terminals 22. Further, the lower end of the retaining portion 351 is stopped by a top portion of the lower insulating body 21, and the corresponding upper insulating block 31 and the lower insulating body 21 limits the retaining portion 351 from moving vertically.

In addition, in this embodiment, the upper grounding portion 353 of each ground terminal 35 extends upward to pass beyond the first mating portion 342 of each signal terminal 34 and enters the upper mating connector 100, and the lower grounding portion 354 of each ground terminal 35 extends downward to pass beyond the second mating portion 343 of each signal terminal 34 and enters the lower mating connector 200.

As shown in FIG. 1, FIG. 3, FIG. 5 and FIG. 10, each retaining portion 351 is provided with a plurality of first clamping slots 3511 and a plurality of second clamping slots 3541. Each first clamping slot 3511 runs upward through the retaining portion 351, and each second clamping slot 3541 runs downward through the corresponding lower grounding portion 354. A plurality of first shielding plates 4 are arranged in parallel along the left-right direction and correspondingly clamped in the first clamping slots 3511. Each first shielding plate 4 extends along the front-rear direction. (That is, each of a left surface and a right surface of each first shielding plate 4 is a plate surface.) Each first shielding plate 4 is clamped in the first clamping slots 3511 aligned along the front-rear direction. The plate surfaces of each first shielding plate 4 are protrudingly provided with a plurality of first elastic sheets 41, and the first elastic sheets 41 downward abut the lower insulating blocks 32. In addition, a front side and a back side of each first shielding plate 4 are respectively provided with two first clamping arms 42. A side edge of each first clamping arm 42 is provided with a first protruding sheet 43 and a first protruding hook 44. As shown in FIG. 5, an upper end of each first shielding plate 4 is higher than the first mating portion 342 of each signal terminal 34, and a lower end of each first shielding plate 4 is lower than the second mating portion 343 of each signal terminal 34, thereby further increasing the shielding area of the first shielding plate 4 to the signal terminals 34 to increase the shielding effect.

Further, a plurality of second shielding plates 5 are arranged in parallel along the left-right direction and correspondingly clamped in the second clamping slots 3541. Each second shielding plate 5 extends along the front-rear direction. (That is, each of a left surface and a right surface of each second shielding plate 5 is a plate surface.) Each second shielding plate 5 is clamped in the second clamping slots 3541 aligned along the front-rear direction. The plate surfaces of each second shielding plate 5 are protrudingly provided with a plurality of second elastic sheets 51, and the second elastic sheets 51 downward abut the lower insulating blocks 32 to prevent the lower insulating blocks 32 from moving upward. In addition, a front side and a back side of each second shielding plate 5 are respectively provided with two second clamping arms 52. A side edge of each second clamping arm 52 is provided with a second protruding sheet 53 and a second protruding hook 54. The first protruding sheet 43 and the second protruding sheet 53 are flush, and the first protruding hook 44 and the second protruding hook 54 are flush. An upper end of each second shielding plate 5 is higher than the first mating portion 342 of each signal terminal 34, and a lower end of each second shielding plate 5 is lower than the second mating portion 343 of each signal terminal 34, thereby further increasing the shielding area of the second shielding plate 5 to the signal terminals 34. In this embodiment, the first shielding plates 4 and the second shielding plates 5 are of the same height, and the first shielding plates 4 and the second shielding plates 5 are arranged alternately along the left-right direction.

Figure 2:
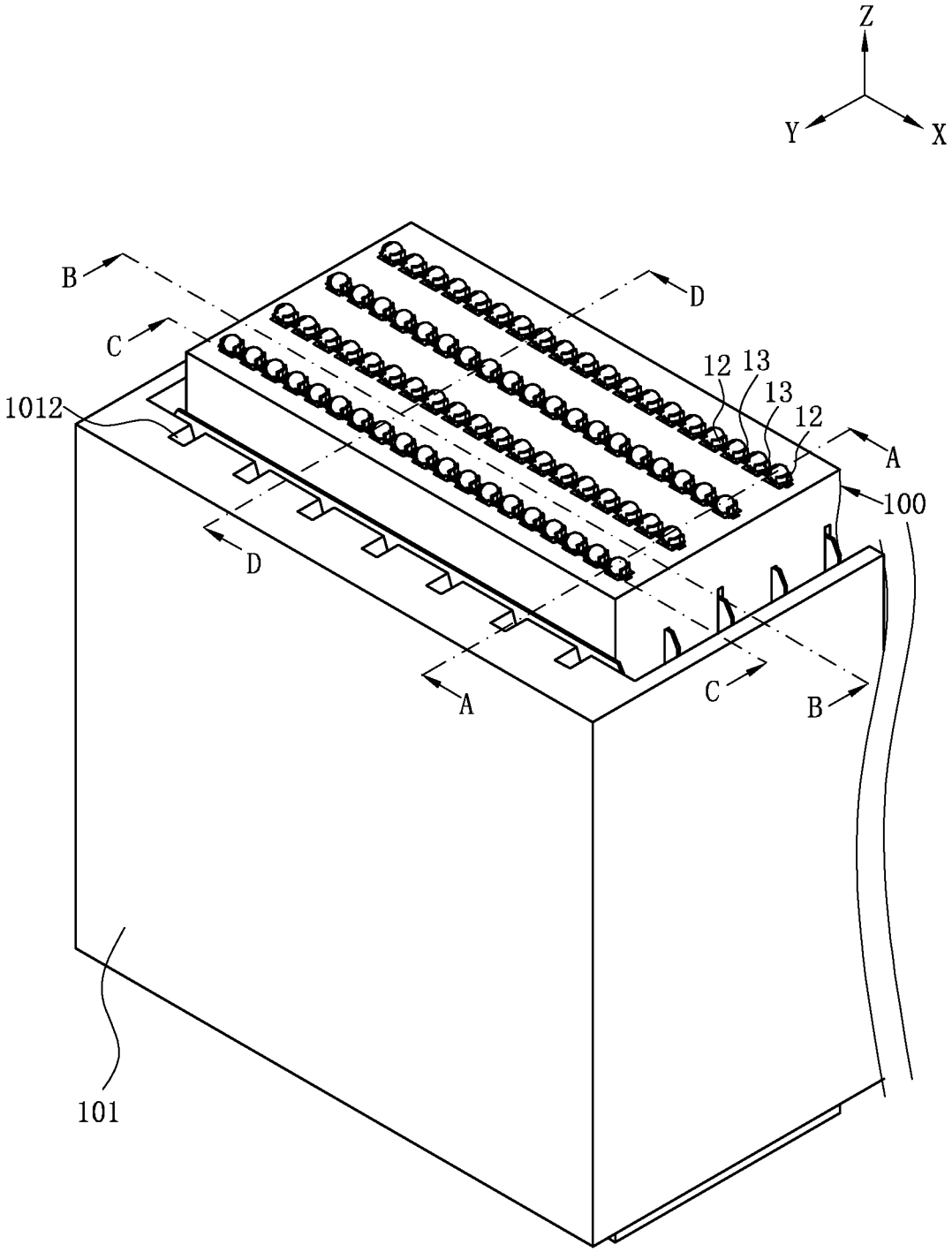
FIG. 2 is a perspective view of the electrical connector according to the first embodiment of the present invention, which is mated with the upper mating connector and the lower mating connector.
Figure 4:
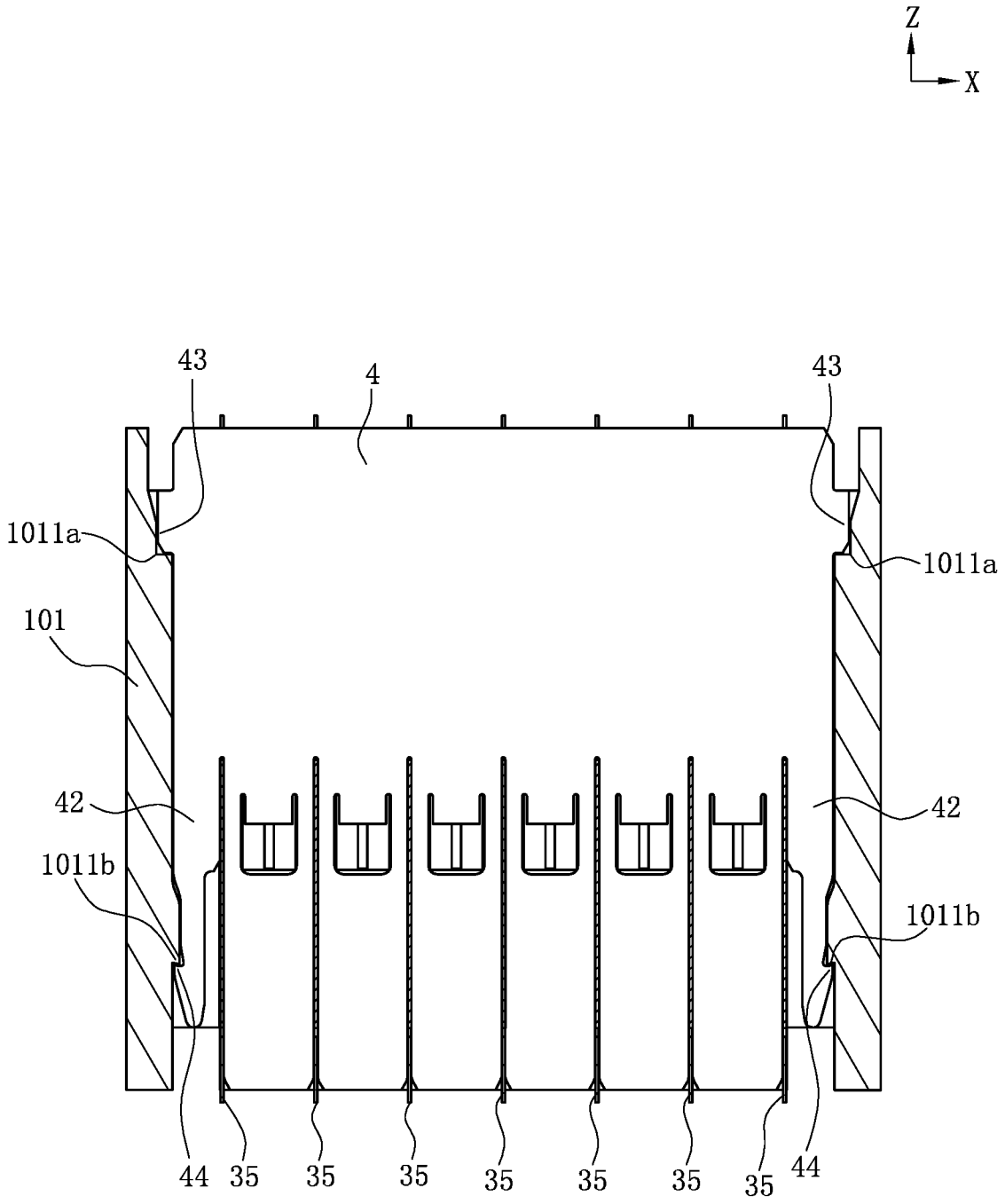
FIG. 4 is a sectional view of FIG. 2 along line B-B after removing the insulating shell.

As shown in FIG. 1, FIG. 2 and FIG. 4, the electrical connector 300 further includes an insulating outer frame 101 in a frame shape. The inner surfaces at a front side and a back side of the insulating outer frame 101 are provided with a plurality of fixing slots 1011, and the inner surfaces at a left side and a right side of the insulating outer frame 101 are provided with a plurality of fixing slots 1012. A left side edge and a right side edge of the retaining portion 351 are respectively provided with two third clamping arms 352 extending upward. A distance exists between each first clamping arm 42, each second clamping arm 52 and the plate surfaces of the retaining portion 351. The fixing slots 1011 accommodate the first clamping arms 42 and the second clamping arms 52, and the positioning slots 1012 accommodate the third clamping arms 352. A fixing concave portion 1011*a* and a fixing protruding portion 1011*b* is provided in each fixing slot 1011. The fixing concave portions 1011*a* of the fixing slots 1011 are correspondingly clamped with the first protruding sheets 43 and the second protruding sheets 53, and the fixing protruding portions 1011*b* of the fixing slots 1011 are correspondingly clamped with the first protruding hooks 44 and the second protruding hooks 54.

FIG. 11 to FIG. 16 show a second embodiment of the present invention, which is different from the first embodiment in that: each first shielding plate 4 is not provided with the first elastic sheets 41. The front surface and the back surface of each signal terminal 34 are plate surfaces. The plate surfaces of the upper grounding portions 353 extending along the left-right direction are parallel to the plate surfaces of the first mating portions 342 extending along the left-right direction, and the plate surfaces of the lower grounding portions 354 extending along the left-right direction are parallel to the plate surfaces of the second mating portions 343 extending along the left-right direction. The front surface and the back surface of each of the first mating terminals 12, the second mating terminals 13, the third mating terminals 22 and the fourth mating terminals 23 are plate surfaces. The first contact portion 121, the second contact portion 131, the third contact portion 221 and the fourth contact portion 231 are formed by puncturing. A plurality of insulating blocks 3 are arranged in a row along the front-rear direction, and each insulating block 3 is located between and clamped by two adjacent retaining portions 351 in the front-rear direction. The signal terminals 34 are retained in the insulating blocks 3. A plate surface of each first mating portion 342 is in contact with a plate surface of a corresponding second contact portion 131 along the front-rear direction, and a plate surface of each second mating portion 343 is in contact with a plate surface of a corresponding fourth contact portion 231 along the front-rear direction. A back surface of each upper grounding portion 353 is correspondingly in contact with the front surfaces of a plurality of first contact portions 121 arranged along the left-right direction, and a back surface of each lower grounding portion 354 is correspondingly in contact with the front surfaces of a plurality of third contact portions 221 arranged along the left-right direction. In other embodiments, a front surface of each upper grounding portion 353 is correspondingly in contact with the back surfaces of two corresponding first contact portions 121 arranged along the left-right direction, and a front surface of each lower grounding portion 354 is correspondingly in contact with the back surfaces of two corresponding third contact portions 221 arranged along the left-right direction, and are thus not hereinafter limited thereto. A plurality of metal sheets 6 are respectively provided between two rows of the first mating terminals 12 and two rows of the third mating terminals 22. Each metal sheet 6 extends along the front-rear direction (in other words, each of a left side surface and a right side surface of each metal sheet 6 is a plate surface), and a left side and a right side of each metal sheet 6 are respectively provided with a plurality of conductive portions 61. The conductive portions 61 located on the upper insulating body 11 are in contact with the corresponding two rows of the first contact portions 121, and the conductive portions 61 located on the lower insulating body 21 are in contact with the corresponding two rows of the third contact portions 221, thereby further increasing the shielding effect of the electrical connector 300. Other structures of the second embodiment are identical to those of the first embodiment, and are thus not elaborated hereinafter.

In sum, the electrical connector 300 according to certain embodiments of the present invention has the following beneficial effects:

1. Each of the ground terminals 35 is provided to be in contact with two corresponding first mating terminals 12 in a left-right direction. The terminals may mate with the first and second mating terminals 12, 13 under the same specification, thus facilitating unified automatic production of the mating connector, and may achieve the objectives for increasing the shielding effect of the electrical connector 300 and saving the quantity of the terminals without changing the size of the electrical connector 300.

2. In the first embodiment, each of the signal terminals 34 is in contact with the corresponding second mating terminal 13 along the left-right direction, and each of the ground terminals 35 is clamped by the two corresponding first mating terminals 12 in the left-right direction, thus increasing the shielding effect of the electrical connector 300, preventing the ground terminals 35 from loosening and moving during mating, and enhancing the mating stability of the ground terminals 35 and the corresponding first mating terminals 12.

3. In the first embodiment, each of the signal terminals 34 is in contact with the corresponding second mating terminal 13 along the front-rear direction, and the back surface each of the ground terminals 35 is in contact with the two corresponding first mating terminals 12 in the left-right direction, thus increasing the shielding effect of the electrical connector 300, and ensuring the ground terminals 35 to be easily in contact with the corresponding first mating terminals 12 by surface contacting.

4. A width of the retaining portion 351 along the left-right direction is greater than a width of each of the upper grounding portion 353 and the lower grounding portion 354 along the left-right direction, such that the retaining portion 351 may provide sufficient locations for inserting the second shielding plates 5 and the first shielding plates 4, facilitating the shielding functions of the second shielding plates 5 and the first shielding plates 4 to the signal terminals 34, and allowing the second shielding plates 5 and the first shielding plates 4 to be electrically conductive to the ground terminals 35, thereby further increasing the grounding functions of the electrical connector 300.

5. By providing the first and second clamping arms 42, 52, the first and second protruding hooks 44, 54 and the first and second protruding sheets 43, 53, the second shielding plates 5, the first shielding plates 4 and the ground terminals 35 are altogether clamped and fixed to the insulating outer frame 101, thus ensuring the first and second shielding plates 4, 5 to stably fix to the ground terminals 35 without loosening. A distance exists between each first clamping arm 42, each second clamping arm 52 and the retaining portion 351, thus ensuring that the first and second clamping arms 42, 52 do not deform and scratch the retaining portions 351 during the clamping process with the insulating outer frame 101.

6. The first contact portion 121 and the second contact portion 131 are of a same height, and the third contact portion 221 and the fourth contact portion 231 are of a same height, allowing the electrical connector 300 to simultaneously perform grounding and signal transmission, which is conducive to stabilizing the transmission efficiency of the electrical connector 300.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to mate with a mating connector along a vertical direction, the mating connector comprising two rows of first mating terminals and two rows of second mating terminals, each of the two rows of first mating terminals and each of the two rows of second mating terminals are arranged along a front-rear direction, the electrical connector comprising:

a row of ground terminals arranged along the front-rear direction, wherein the ground terminals and the first mating terminals are provided in the vertical direction, each of the ground terminals has a retaining portion in a flat plate shape and a grounding portion, each of a front surface and a back surface of the retaining portion is a plate surface, the grounding portion is in the flat plate shape, each of a front surface and a back surface of the grounding portion is a plate surface, and the grounding portion of each of the ground terminals is in contact with two corresponding first mating terminals of the first mating terminals in a left-right direction; and two rows of signal terminals, wherein each of the two rows of signal terminals are arranged along the front-rear direction, the signal terminals and the second mating terminals are provided in the vertical direction, each of the signal terminals is one-to-one in contact with a corresponding one of the second mating terminals, and a location of each of the signal terminals in contact with the corresponding one of the second mating terminals and a location of each of the ground terminal in contact with the two corresponding first mating terminals are both located on a same horizontal plane perpendicular to the vertical direction.

2. The electrical connector according to claim 1, wherein each of the signal terminals is in contact with the corresponding one of the second mating terminals along the front-rear direction, and one of a front surface and a back surface of each of the ground terminals is in contact with the two corresponding first mating terminals in the left-right direction.

3. The electrical connector according to claim 2, further comprising a row of insulating blocks arranged along the front-rear direction, wherein each of the insulating blocks is located between and clamped by the retaining portions of two of the ground terminals adjacent to each other in the front-rear direction, and the signal terminals are retained in the insulating blocks.

4. The electrical connector according to claim 1, wherein each of the signal terminals is in contact with the corresponding one of the second mating terminals along the left-right direction, and each of the ground terminals is clamped by the two corresponding first mating terminals in the left-right direction.

5. The electrical connector according to claim 4, wherein the mating connector is provided with an insulating body retaining the first mating terminals and the second mating terminals, each row of the two rows of signal terminals is fixed in an insulating block, one of an upper end and a lower end of the retaining portion is stopped by the insulating block, and the other of the upper end and the lower end of the retaining portion is stopped by the insulating body, such that the insulating block and the insulating body limit the retaining portion from moving vertically.

6. The electrical connector according to claim 1, wherein a width of the retaining portion along the left-right direction is greater than a width of the grounding portion along the left-right direction.

7. The electrical connector according to claim 1, wherein the retaining portion is provided with a clamping slot, a shielding plate is clamped in the clamping slot, the shielding plate is located between the two rows of signal terminals in the left-right direction, and each of a left surface and a right surface of the shielding plate is a plate surface.

8. The electrical connector according to claim 7, further comprising an insulating outer frame, wherein an inner side surface of the insulating outer frame is provided with a plurality of fixing slots, two clamping arms are provided respectively at a front side and a back side of the shielding plate, a side edge of each of the two clamping arms is provided with a protruding sheet and a protruding hook, the clamping arms are accommodated in the fixing slots, each of the fixing slots is provided with a fixing concave portion to correspondingly clamp the protruding sheet of a corresponding one of the clamping arms, and each of the fixing slots is provided with a fixing protruding portion to correspondingly clamp the protruding hook of the corresponding one of the clamping arms.

9. An electrical connector assembly, comprising:

a mating connector, comprising two rows of first mating terminals and two rows of second mating terminals, wherein each of the two rows of first mating terminals and each of the two rows of second mating terminals are arranged along a front-rear direction, each of the first mating terminals is provided with a first contact portion, each of the second mating terminals is provided with a second contact portion, and the first contact portion and the second contact portion are both located on a same horizontal plane perpendicular to the vertical direction; and an electrical connector, configured to mate with a mating connector along a vertical direction, the electrical connector comprising:

a row of ground terminals arranged along the front-rear direction, wherein the ground terminals and the first mating terminals are provided in the vertical direction, each of the ground terminals has a retaining portion in a flat plate shape and a grounding portion, each of a front surface and a back surface of the retaining portion is a plate surface, the grounding portion is in the flat plate shape, each of a front surface and a back surface of the grounding portion is a plate surface, and the grounding portion of each of the ground terminals is in contact with the first contact portions of two corresponding first mating terminals of the first mating terminals in a left-right direction; and two rows of signal terminals, wherein each of the two rows of signal terminals are arranged along the front-rear direction, the signal terminals and the second mating terminals are provided in the vertical direction, each of the signal terminals has a first mating portion, and the first mating portion is one-to-one in contact with the second contact portion of a corresponding one of the second mating terminals.

10. The electrical connector assembly according to claim 9, wherein the first mating portion is in contact with the second contact portion of the corresponding one of the second mating terminals along the front-rear direction, and one of a front surface and a back surface of each of the ground terminals is in contact with the first contact portions of the two corresponding first mating terminals in the left-right direction.

11. The electrical connector assembly according to claim 10, further comprising a row of insulating blocks arranged along the front-rear direction, wherein each of the insulating blocks is located between and clamped by the retaining portions of two of the ground terminals adjacent to each other in the front-rear direction, and the signal terminals are retained in the insulating blocks.

12. The electrical connector assembly according to claim 9, wherein the first mating portions of the two rows of signal terminals are located between the two second contact portions of the two rows of second mating terminals, the first mating portion of each of the signal terminals is in contact with the second contact portion of the corresponding one of the second mating terminals along the left-right direction, and each of the ground terminals is clamped by the first contact portions of the two corresponding first mating terminals in the left-right direction.

13. The electrical connector assembly according to claim 12, wherein the mating connector is provided with an insulating body retaining the first mating terminals and the second mating terminals, each row of the two rows of signal terminals is fixed in an insulating block, one of an upper end and a lower end of the retaining portion is stopped by the insulating block, and the other of the upper end and the lower end of the retaining portion is stopped by the insulating body, such that the insulating block and the insulating body limit the retaining portion from moving vertically.

14. The electrical connector assembly according to claim 9, wherein the first mating terminals and the second mating terminals are arranged to align in the front-rear direction, the mating connector is provided with a metal sheet extending along the front-rear direction between the two rows of first mating terminals, and a plurality of conductive portions are protrudingly provided at a left side and a right side of the metal sheet to be in contact with the corresponding two rows of first mating terminals.

15. The electrical connector assembly according to claim 9, wherein the mating connector is provided with an insulating body, each of the first mating terminals is provided with a positioning portion retained in the insulating body, and the retaining portion of each of the ground terminals vertically overlaps with the positioning portion of each of the two corresponding first mating terminals.

16. The electrical connector assembly according to claim 9, wherein a plate surface of the first mating portion of each of the signal terminals is in contact with a plate surface of the second contact portion of the corresponding one of the second mating terminals, and each of the first mating terminals and each of the second mating terminals have identical structures.

17. The electrical connector assembly according to claim 9, further comprising another mating connector, wherein the mating connector and the another mating connector are located at an upper side and a lower side of the electrical connector, the another mating connector comprises two rows of third mating terminals and two rows of fourth mating terminals, each row of the two rows of third mating terminals and each row of the two rows of fourth mating terminals are arranged along the front-rear direction, each of the third mating terminals is provided with a third contact portion, each of the fourth mating terminals is provided with a fourth contact portion, the third contact portion and the fourth contact portion are of a same height, each of the ground terminals is in contact with the third contact portions of two corresponding first mating terminals of the first mating terminals in the left-right direction, each of the signal terminals is provided with a second mating portion, the second mating portion is one-to-one in contact with the fourth contact portion of a corresponding one of the fourth mating terminals, an upper end of each of the ground terminals passes upward beyond an upper end of each of the signal terminals, a lower end of each of the ground terminals passes upward beyond a lower end of each of the signal terminals, and the upper end and the lower end of each of the ground terminals enter the mating connector and the another mating connector.

18. The electrical connector assembly according to claim 9, wherein the electrical connector comprises a plurality of upper insulating blocks and a plurality of lower insulating blocks, each of the signal terminals comprises an upper retaining section retained in a corresponding one of the upper insulating blocks, a lower retaining section retained in a corresponding one of the lower insulating blocks, and a connecting section connecting the upper retaining section and the lower retaining section and exposed to the corresponding one of the upper insulating blocks and the corresponding one of the lower insulating blocks, and an upper end of the retaining portion is upward stopped by the corresponding one of the upper insulating blocks.

19. The electrical connector assembly according to claim 18, wherein the retaining portion is provided with a clamping slot, a shielding plate is clamped in the clamping slot, the shielding plate is located between the two rows of signal terminals in the left-right direction, each of a left surface and a right surface of the shielding plate is a plate surface, the plate surfaces of the shielding plate is protrudingly provided with a plurality of elastic sheets, and the elastic sheets downward abut the corresponding one of the lower insulating blocks.

20. The electrical connector assembly according to claim 9, wherein a width of the retaining portion along the left-right direction is greater than a width of the grounding portion along the left-right direction.

* * * * *